US005545488A

United States Patent [19]

Burke

[11] Patent Number: 5,545,488

[45] Date of Patent: Aug. 13, 1996

[54] SELF-STABILIZING EXTRUSION FOR CLOSURE ASSEMBLIES

[75] Inventor: Ralph C. Burke, Acworth, Ga.

[73] Assignee: AWNEX, Incorporated, Woodstock, Ga.

[21] Appl. No.: 195,938

[22] Filed: Feb. 14, 1994

[51] Int. Cl.[6] ..... E04H 15/32

[52] U.S. Cl. ..... 428/586; 428/595; 428/598; 52/63; 52/222; 160/391; 160/398

[58] Field of Search ..... 428/586, 595, 428/598; 52/63, 73, 74, 202, 203, 222; 160/391, 392, 393, 394, 395, 396, 397, 398, 399, 404

[56] References Cited

U.S. PATENT DOCUMENTS

| | | | |
|---|---|---|---|
| 4,926,605 | 5/1990 | Milliken et al. | 52/63 |
| 5,044,131 | 9/1991 | Fisher | 160/392 |
| 5,076,033 | 12/1991 | Patsy | 52/63 |
| 5,237,785 | 8/1993 | Lukes | 52/202 |
| 5,242,004 | 9/1993 | Stilling | 160/395 |
| B1 4,926,605 | 6/1993 | Milliken et al. | 52/63 |

FOREIGN PATENT DOCUMENTS

| | | | |
|---|---|---|---|
| 375652 | 6/1990 | European Pat. Off. | 52/63 |
| 522798 | 9/1969 | Germany . | |

*Primary Examiner*—John Zimmerman
*Attorney, Agent, or Firm*—Needle & Roseenberg, P.C.

[57] ABSTRACT

A self-stabilizing extrusion for closure assemblies, including awnings, canopies, and displays having an elongated hollow frame substantially rectangular in vertical cross-section with inside and outside surfaces which is constructed of a top wall perpendicularly connected to parallel side walls terminating in perpendicular flange members parallel to the top wall. A slot opening is formed between the flange members for the receipt of closure material. The side walls are also interconnected by a slot base to which the closure material is affixed. A base support is provided between the slot base and the inside surface of the top wall. The slot is defined by the slot opening, the inside surfaces of the side walls below the slot base, and the slot base. The top and side walls may also include a plurality of stabilizing recesses and stabilizing notches. The corners are also equipped with stabilizing recesses.

12 Claims, 4 Drawing Sheets

SELF-STABILIZING EXTRUSION FOR CLOSURE ASSEMBLIES

FIELD OF THE INVENTION

The present invention relates to framed closure and more specifically, to a self-stabilizing extrusion for the construction of awnings, canopies, coverings, displays, and other similar structures.

BACKGROUND OF THE INVENTION

Typically, awnings, canopies, coverings, displays, and other similar structures are constructed of an elongated frame or support structure to which a covering material is anchored. The frame is conventionally constructed of a stiff, yet malleable light-weight material such as aluminum, in order to achieve a variety of special shapes. The frame is usually rectangular in vertical cross-section, and has a longitudinal slot, or channel, extending the length of the frame, within which the closure material is anchored, for example by a staple. The construction generally attempts to offer flexibility of form in that the frame members can be bent to produce closure assemblies having arcuate shapes.

However, the prior art has failed to eliminate the problem of twisting and warping of the frame members that occurs when they are bent into the desired forms. This misshaping occurs due to the opposed compression and tension forces applied to the hollow frame member during arcuate bending. This frame misshaping may also prevent access to the closure anchoring slot in the frame member due the "cupping effect." This necessitates reopening the slot by hand, which is laborious and adds further inconsistencies to the final frame shape. Accordingly, it is a goal of the present invention to provide a self-stabilizing extrusion for closure assemblies which maximizes stabilization against misshaping due to bending, while minimizing the overall weight of the extrusion.

SUMMARY OF THE PRESENT INVENTION

The present invention is a self-stabilizing extrusion for closure assemblies including awnings, canopies, coverings, displays, and other similar structures, which includes an elongated hollow frame substantially rectangular in cross-section. The frame has opposing side walls connected to a top wall. The side walls terminate on their bottom ends in inwardly directed flange members, which are parallel to the top wall, and which form therebetween a slot opening. The frame also includes a slot base, which extends between and is affixed to the side walls, and a base support, which extends between and is affixed to the inside surface of the top wall and the slot base.

The slot is defined by the slot opening, the inside surfaces of the side walls below the slot base and the slot base. The slot serves as an anchoring site for the closure material. The structural integrity of the frame, including the slot, is maintained in part by the base support. The base support is preferably centrally disposed and affixed to the middle of the inside surface of the top wall and the middle of the slot base. However, the invention contemplates a plurality of evenly spaced or radially arranged base supports extending from the inside surface of the top wall to the slot base.

In the preferred embodiment, the slot base has a first portion extending from one side wall to the base support, and a second portion extending from the other side wall to the base support. The juncture of the first and second portions of the slot base preferably forms an angle of about 160° in the direction of the slot.

The preferred embodiment of the self-stabilizing extrusion for closure assemblies further has stabilizing recesses evenly disposed on the inside and outside surfaces of the frame. The stabilizing recesses serve to absorb the twisting and misshaping forces associated with frame bending. The stabilizing recesses may be disposed in a variety of stress absorbing positions, but are preferably arranged such that two stabilizing recesses are disposed on the outside surfaces of the top and both first and second outside side walls, one stabilizing recess is centrally disposed on the inside surfaces of the top and both the first and second side walls, and four corner stabilizing recesses are individually disposed at the inside junctures of the top, first and second side walls and flange members. The stabilizing recesses on the side walls are preferably partially trapezoidal in cross-sectional shape and the stabilizing recesses in the corners are preferentially partially rounded in cross-sectional shape. Additionally, the preferred embodiment of the self-stabilizing extrusion for closure assemblies has stabilizing notches centrally located on the outside surfaces of the top and both the first and second walls. Additionally, in the preferred embodiment of the self-stabilizing extrusion for closure assemblies the flange members are thicker than the top and side walls, and the slot base is thicker than the base support in cross-section.

DETAILED DESCRIPTION OF THE INVENTION

FIGS. 1–8 show preferred embodiments of the present invention. While the configurations according to the illustrated embodiments are preferred, it is envisioned that alternative configurations may be adopted without departing from the invention as contemplated. For descriptive purposes, it is helpful to use the terms "affixed" or "connected" to denote the relative configuration of the various components of the present invention, however, it should be understood that the invention is manufactured using a continuous extrusion process.

Figure 1:
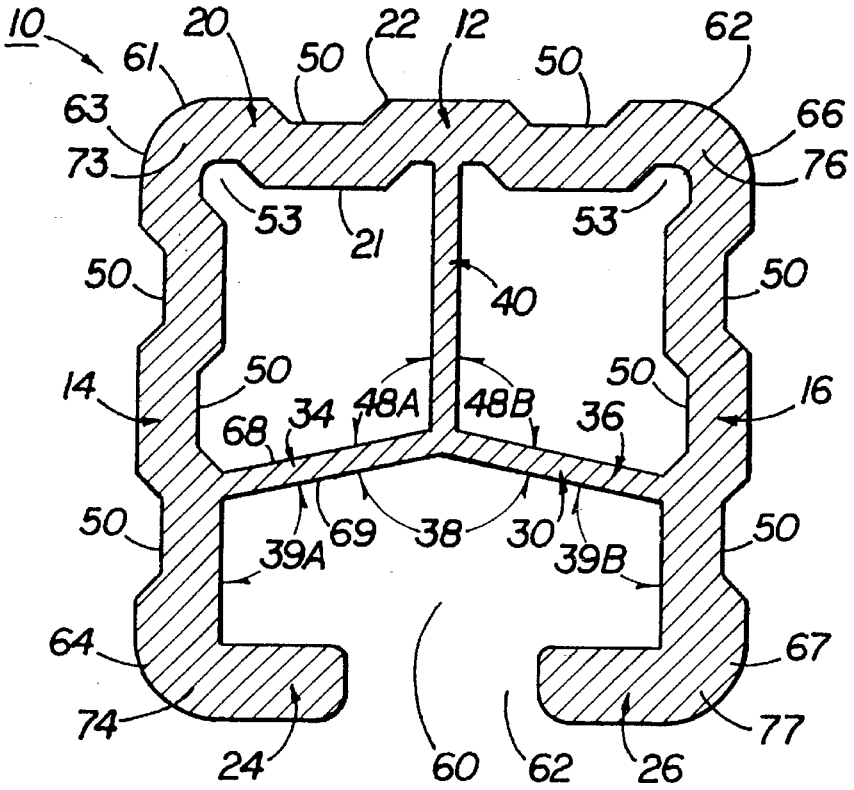
FIG. 1 is a view of the preferred first embodiment of the present invention in vertical cross-section.

Referring to FIG. 1, the self-stabilizing extrusion for closure assemblies, generally indicated as 10, comprises an elongated hollow frame 20, which is substantially rectangular in vertical cross-section, with an inside surface 21 and an outside surface 22, as shown. The frame 20 is defined by a top wall 12, a first side wall 14, and a second side wall 16. The top wall 12 has a first edge 61 and an opposed parallel second edge 62. The first side wall 14 has a first top end 63 and a opposed parallel first bottom end 64. The second side wall 16 similarly has a second top end 66 and an opposed parallel second bottom end 67. The first edge 61 of the top wall 12 is perpendicularly connected to the first top end 63 of the first side wall 14. The second edge 62 of the top wall 12 is perpendicularly connected to the second top end 66 of the second side wall 16. Thus, the first side wall 14 is in opposed parallel relationship to the second side wall 16.

Figure 5:
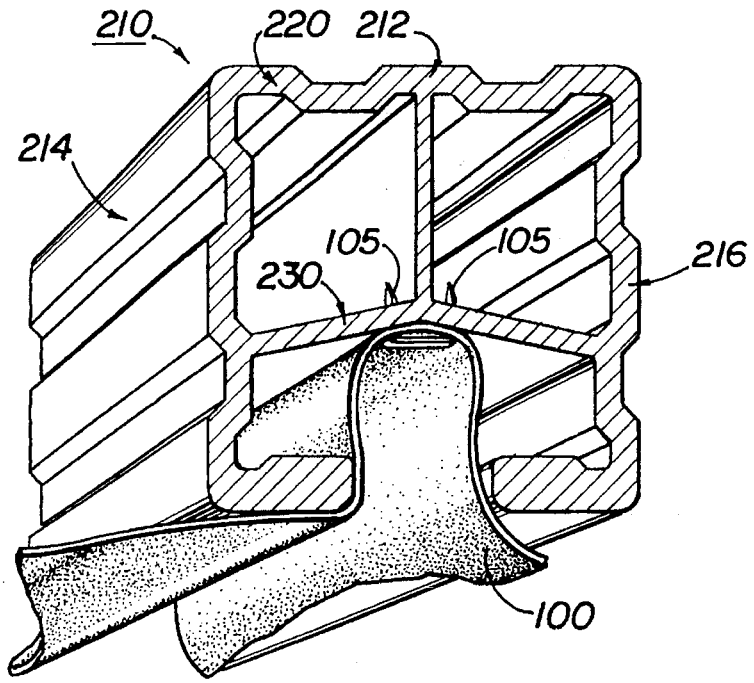
FIG. 5 is a partial perspective view of the second embodiment of the present invention assembled with a closure material.

The first bottom end 64 of the first side wall 14 terminates in an inwardly perpendicular flange member 24, which is parallel to the top wall 12. The second bottom end 67 of the second side wall 16 similarly terminates in an inwardly perpendicular second flange member 26, which is also parallel to the top wall 12. The first and second flange members 24, 26 define therebetween a slot opening 62 for receiving therein closure material 100, as shown in FIG. 5.

The first side wall 14 and the second side wall 16 are interconnected by a slot base 30 with a top surface 68 and a bottom surface 69. The slot base 30 is buttressed by a base support 40, which extends between and is affixed to the inside surface 21 of the top wall 12 and the top surface 68 of the slot base 30.

A longitudinal slot 60 is provided along the length of the frame 20 for receiving therein closure material 105. The slot 60 is defined by the slot opening 62, the inside surface 21 of the first and second side walls 14, 16 below the slot base 30, and the bottom surface 69 of the slot base 30. As seen in FIG. 5, the closure material 100 is attached to the self-stabilizing construction 10 by affixing the material inside the slot 60 to the slot base 30. This attachment may be achieved by the use of staples 105, for example.

In the preferred embodiment of FIG. 1, the base support 40 is centrally disposed and affixed between the middle inside surface 21 of the top wall 12 and the middle top surface 68 of the slot base 30. The slot base 30 is thus bisected to create a first slot base portion 34 extending from the first slot wall 14 to the base support 40, and a second slot base portion 36 extending from the second side wall 16 to the base support 40. The juncture of the first and second slot base portions 34, 36 forms an angle 38 of less than 180° in cross-section in the direction of the slot 60. Preferably, this angle is about 160°. The juncture of the base support 40 and the first and second slot base portions 34, 36 forms an angle 48A and 48B on either side of the base support 40 of greater than 90° in cross-section, and preferably about 100°. The juncture of the first and second slot base portions 34, 36 with the bottom ends 64, 67 of the side walls 14, 16 form angles 39A, 39B of greater than 90°, and preferably about 100°, in cross-section in the direction of the slot 60

The self-stabilizing extrusion 10 overcomes the "cupping effect," which occurs while bending. The "cupping effect" is the tendency of prior art slot constructions to collapse inwards as bending forces are applied, thus causing uneven warpage and preventing access to the slot for closure material attachment. During bending of the present invention, the base support 40 is forced towards the slot opening 62, which force is transferred to the slot base 30 and out through the first and second side walls 14, 16 via the first and second slot base portions 34, 36. This may result in a slight decreasing of the angles 48A and 48B and increasing of the angle 38 of the slot base 30, however, more importantly the slot opening 62 remains open and accessible. Angles 39A and 39B cooperate to provide additional support for overcoming the "cupping effect." In addition, angle 38 causes first and second slot base portions 34, 36 to provide more satisfactory surfaces for the attachment of staples because of the angle at which the conventional stapler nose (not shown) is commonly inserted into the slot 60.

Figure 2:
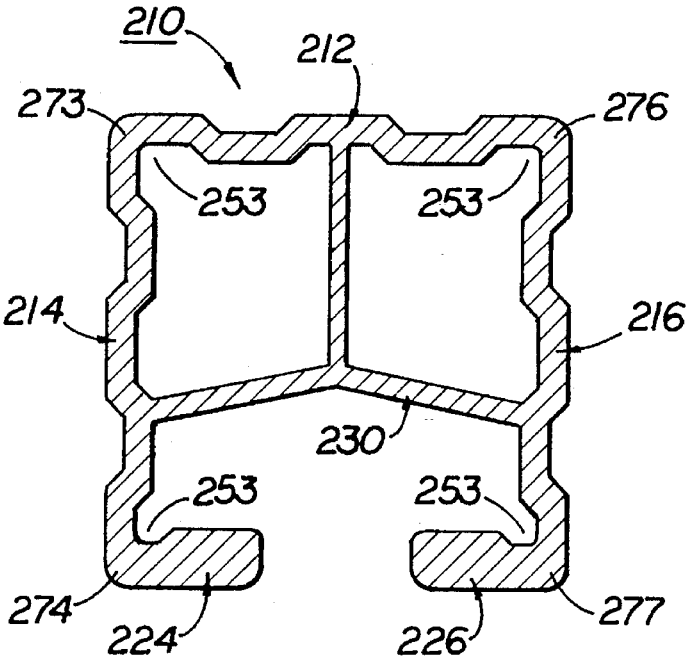
FIG. 2 is a view of the second embodiment of the present invention in vertical cross-section.

According to the structural needs of a particular self-stabilizing extrusion 10, the components may be constructed of various relative thicknesses in cross-section in order to meet the goal of providing maximum stabilization against misshaping due to bending, while minimizing the overall weight of the extrusion. Generally, the slot base 30 is of a greater thickness than the base support 40. As seen in FIG. 2, the inwardly directed flange members 224, 226 may be thicker than the top wall 212 and the first and second side walls 214, 216 in cross-section.

The embodiments of FIGS. 1–8 also utilize a series of stabilizing recesses 50 disposed along the top wall 12 and the first and second side walls 14, 16 of the frame 20. Also, corner stabilizing recesses 53 are individually disposed at the inside surface 21 junctures of the top wall 12 and the first and second side walls 14, 16, and the junctures of the first and second side walls 14, 16 and the flange members 24, 26. Corner stabilizing recesses 53 may be positioned individually or in any combination in the four corners 73, 74, 76, 77. Only the two corners 73, 76 are equipped with corner stabilizing recesses 53 in FIG. 1 (and corners 473, 476 in FIG. 4), whereas in FIG. 2 all four corners 273, 274, 276, 277 have corner stabilizing recesses 253. Additionally, it may be helpful to configure the recesses 253 in the top corners 273, 274 to be larger than the recesses 253 in the bottom corners 274, 277, as in FIG. 2. In FIG. 1, and correspondingly in FIGS. 2–8, the stabilizing recesses 50 on the walls 12, 14, 16 are partially trapezoidal in shape in cross-section and the corner stabilizing recesses 53 are partially rounded in cross-sectional shape.

Figure 7:
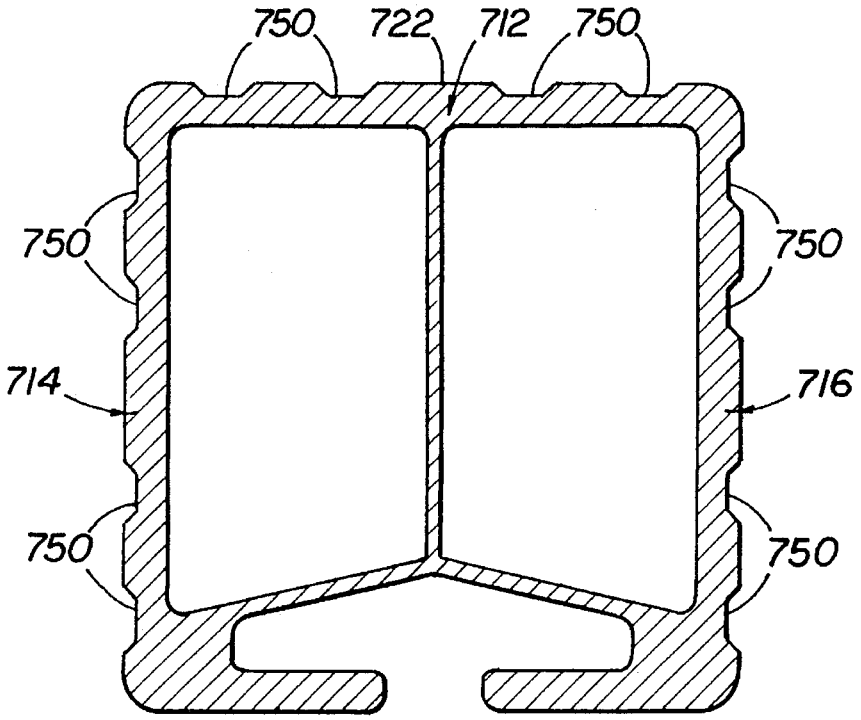
FIG. 7 is a view of the fifth embodiment of the present invention in vertical cross-section.

These stabilizing recesses 50, 53 provide the frame 20 with additional resistance to warpage and bending distortions. The stabilizing recesses 50, 53 are intended to absorb bending stresses such that the overall rectangular integrity of the frame 20 is maintained as much as possible. As seen in FIG. 1, the stabilizing recesses 50 are distributed on the frame 20 in an alternating pattern, wherein two stabilizing recesses 50 are disposed on each of the outside surfaces 22 of the top wall 12 and both first and second outside walls 14, 16; one stabilizing recess 50 is centrally disposed on each of the inside surfaces 21 of the top wall 12 and both the first and second walls 14, 16; and four corner stabilizing recesses 53 are individually disposed at the inside surfaces 21 of the junctures of the top wall 12 and the first and second side walls 14, 16, and the junctures of the first and second side walls 14, 16 and the flange members 24, 26. Alternatively, as seen in FIG. 7, the stabilizing recesses 750 are disposed only upon the outside surface 722 of the walls 712, 714, 716.

Figure 3:
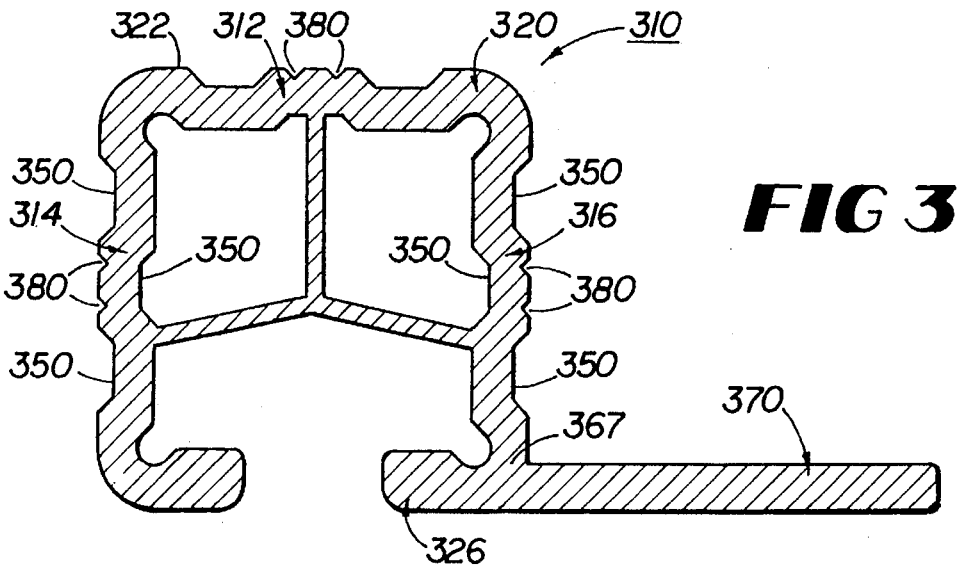
FIG. 3 is a view of the third embodiment of the present invention in vertical cross-section.

As seen in FIG. 3, the frame 320 may be equipped with stabilizing notches 380 on the outside surfaces 322 of the top wall 312 and the first and second side walls 314, 316. These stabilizing notches 380 are essentially small indentations, which are distributed in pairs on the walls 312, 314, 316 between the stabilizing recesses 350 on the outside surfaces 322. The stabilizing notches 380 are intended to provide further absorption of warping forces during bending to maintain the cross-sectional rectangular shape of the frame 320. FIG. 3 also shows a self-stabilizing extrusion 310 equipped with an extension 370 horizontally extending from the second bottom end 367 the second side wall 316 in the direction opposite the flange member 326. The extension 370 serves to provide support for the closure material 100 (as seen in FIG. 5) along the length thereof.

Figure 4:
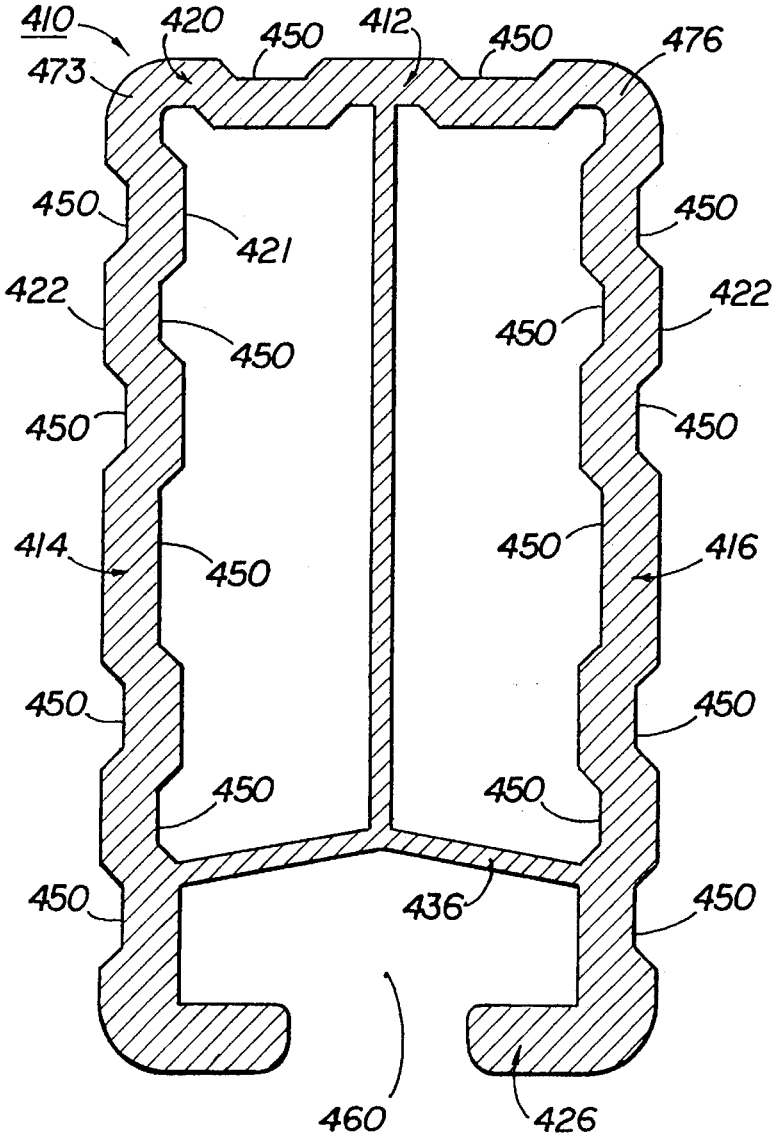
FIG. 4 is a view of the fourth embodiment of the present invention in vertical cross-section.

As seen in FIG. 4, the frame 420 is shaped in an elongated rectangle form in vertical cross-section, wherein the side walls 414, 416 are longer than the top 412. The present invention contemplates a variety of such rectangular shapes, depending on the desired shape of the closure assembly. Furthermore, additional stabilizing recesses 450 are distributed on the inside surface 421 and outside surface 422 of the first and second side walls 414, 416 for the reasons mentioned above.

Figure 6:
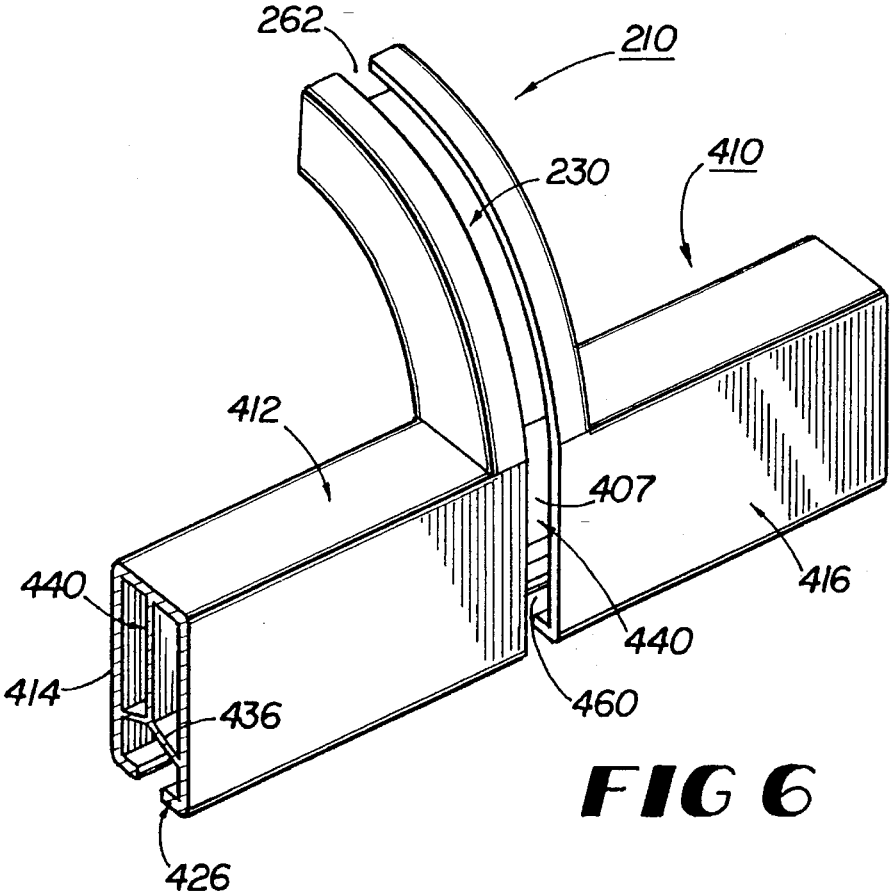
FIG. 6 is a partial perspective view of the present invention assembled as a joint between two self-stabilizing extrusions of the second embodiment and the fourth embodiment.

As seen in FIG. 6, an additional feature of the base support 460 is shown. After routing through joints to make an opening 407 for closure material 100 (not shown) insertion, the base support 440 becomes exposed and doubles as a staple receiving surface, allowing the securing of the corners of the closure material 100. FIG. 6 shows a joint between two self-stabilizing extrusions 210 and 410. Extrusion 210 is bent into an arc, with slot base 230 being visible through the slot opening 262 from the outer perimeter of the arc. Extrusion 410 has a somewhat more elongate rectangular vertical cross-section than extrusion 210, as in FIG. 4, although the more elongate shape is not required. Note that the stabilizing recesses are not shown for simplicity in FIG. 6. A portion of second side wall 416, second slot base portion 436, and inwardly directed flange member 426 of extrusion 410 have been removed by routing to form an opening 407 contiguous with slot opening 262 of extrusion 210. It should be recognized that the orientation of the extrusion 410 could be reversed such that routing is performed on the first side wall 414. Base support 440 can form an essentially contiguous surface with slot base 230, provided the distance from the slot opening 262 to the slot base 230 of extrusion 210 is essentially equal to the distance between the side wall 416 and the stabilizer 440 of extrusion 410. In such a configuration, base support 440 can advantageously serve as an additional staple receiving surface for closure material.

Figure 8:
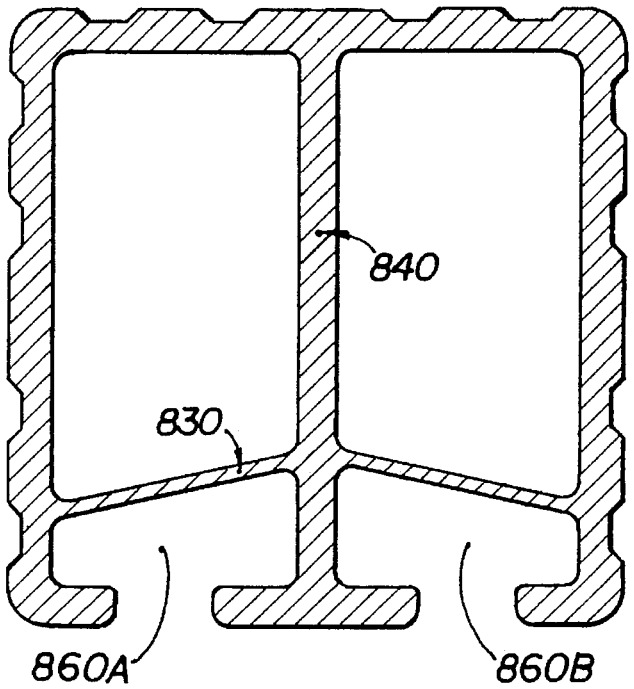
FIG. 8 is a view of the sixth embodiment of the present invention in vertical cross-section.

As seen in FIG. 7, the stabilizing recesses 750 may be disposed only upon the outside surface 722 of the frame 720. As seen in FIG. 8, the base support 840 may extend below the slot base 830 to form two elongated slots 860A and 860B. Furthermore, the invention contemplates a plurality of base supports, which would form therebetween a proportional number of elongated slots. These and other aspects of the invention will be apparent to one with skill in the art.

I claim:

1. A self-stabilizing extrusion for closure assemblies comprising:

a. an elongated hollow frame substantially rectangular in vertical cross-section having an outside surface and an inside surface, defined by a top wall having parallel opposed first and second edges, a first side wall having a first top end and a parallel opposed first bottom end, the first edge of the top wall being perpendicularly connected to the first top end of the first side wall, a second side wall having a second top end and a parallel opposed second bottom end, the second edge of the top wall being perpendicularly connected to the second top end of the second side wall, wherein the first and second side walls are in opposed parallel relationship, and wherein the bottom ends of the first and second side walls terminate in inwardly perpendicular first and second flange members which are parallel to the top wall;

b. a slot base having a top surface and a bottom surface extending between and affixed to the inside surface of the first and second side walls;

c. a base support extending between and affixed to the inside surface of the top wall and the top surface of the slot base, wherein the base support is centrally disposed between and affixed to the middle of the inside surface of the top wall and the middle of the top surface of the slot base, and;

d. a longitudinal slot in the bottom of the elongated hollow frame defined by a slot opening between the flange members, the inside surfaces of the first and second side walls below the slot base, and the bottom surface of the slot base; and, wherein the slot base further comprises a first slot base portion extending from the first slot wall to the base support and a second slot base portion extending from the first slot wall to the base support, wherein the juncture of the first and second portions of the slot base forms an angle of less than 180° in cross-section in the direction of the slot.

2. The self-stabilizing extrusion for closure assemblies of claim 1, wherein the juncture of first and second portions of the slot base forms an angle of about 160° in the direction of the slot.

3. The self-stabilizing extrusion for closure assemblies of claim 1, further comprising a plurality of first stabilizing recesses spaced along the outside surfaces of the frame and a plurality of second stabilizing recesses on the inside surface of the frame, each of the second recesses being disposed between a pair of first recesses.

4. The self-stabilizing extrusion for closure assemblies of claim 1, wherein two stabilizing recesses are disposed on each of the outside surfaces of the top wall and both first and second outside walls; one stabilizing recess is centrally disposed on each of the inside surfaces of the top wall and both the first and second walls; and four corner stabilizing recesses are individually disposed at the inside junctures of the top wall and the first and second side walls, and the junctures of the first and second side walls and the flange members.

5. The self-stabilizing extrusion for closure assemblies of claim 4, wherein the stabilizing recesses on the walls are partially trapezoidal in shape in cross-section and the stabilizing recesses in the corners are partially rounded in shape in cross-section.

6. The self-stabilizing extrusion for closure assemblies of claim 1, further comprising stabilizing notches centrally located on the outside surfaces of the top wall and both the first and second walls.

7. The self-stabilizing extrusion for closure assemblies of claim 1, wherein the flange members are thicker than the top wall and side walls in cross-section.

8. The self-stabilizing extrusion for closure assemblies of claim 1, wherein the slot base is thicker than the base support in cross-section.

9. A self-stabilizing extrusion for closure assemblies comprising:

a. an elongated hollow frame substantially rectangular in vertical cross-section having an outside surface and an inside surface, defined by a top wall having parallel opposed first and second edges, a first side wall having a first top end and a parallel opposed first bottom end, the first edge of the top wall being perpendicularly connected to the first top end of the first side wall, a second side wall having a second top end and a parallel opposed second bottom end, the second edge of the top wall being perpendicularly connected to the second top end of the second side wall, wherein the first and second side walls are in opposed parallel relationship, and wherein the bottom ends of the first and second side walls terminate in inwardly perpendicular first and second flange members which are parallel to the top wall;

b. a slot base having a top surface and a bottom surface extending between and affixed to the inside surface of the first and second side walls;

c. a base support extending between and affixed to the inside surface of the top wall and the top surface of the slot base, wherein the base support is centrally disposed between and affixed to the middle of the inside surface of the top wall and the middle of the top surface of the slot base, and;

d. a longitudinal slot in the bottom of the elongated hollow frame defined by a slot opening between the flange members, the inside surfaces of the first and second side walls below the slot base, and the bottom surface of the slot base; and, wherein the slot base further comprises a first slot base portion extending from the first slot wall to the base support and a second slot base portion extending from the first slot wall to the base support, wherein the base support forms an angle on both sides thereof at the juncture of the first and second slot base portions of greater than 90° in cross-section.

10. The self-stabilizing extrusion for closure assemblies of claim 9, wherein the base support forms an angle on both sides thereof at the juncture of the first and second slot base portions of about 100° in cross-section.

11. A self-stabilizing extrusion for closure assemblies comprising:

an elongated hollow frame substantially rectangular in vertical cross-section having an outside surface and an inside surface, defined by a top wall having parallel opposed first and second edges, a first side wall having a first top end and a parallel opposed first bottom end, the first edge of the top wall being perpendicularly connected to the first top end of the first side wall, a second side wall having a second top end and a parallel opposed second bottom end, the second edge of the top wall being perpendicularly connected to the second top end of the second side wall, wherein the first and second side walls are in opposed parallel relationship, and wherein the bottom ends of the first and second side walls terminate in inwardly perpendicular first and second flange members which are parallel to the top wall;

b. a slot base having a top surface and a bottom surface extending between and affixed to the inside surface of the first and second side walls;

c. a base support extending between and affixed to the inside surface of the top wall and the top surface of the slot base, wherein the base support is centrally disposed between and affixed to the middle of the inside surface of the top wall and the middle of the top surface of the slot base, and;

d. a longitudinal slot in the bottom of the elongated hollow frame defined by a slot opening between the flange members, the inside surfaces of the first and second side walls below the slot base, and the bottom surface of the slot base; and, wherein the slot base further comprises a first slot base portion extending from the first slot wall to the base support and a second slot base portion extending from the first slot wall to the base support, wherein the first and second bottom ends of the first and second side walls form angles at their respective junctures with the first and second slot base portions of greater than 90° in cross-section in the direction of the slot.

12. The self-stabilizing extrusion for closure assemblies of claim 11, wherein the first and second bottom ends of the first and second side walls form angles at their respective junctures with the first and second slot base portions of about 100° in cross-section in the direction of the slot.

* * * * *